US006453517B1

(12) United States Patent
Tanaka

(10) Patent No.: US 6,453,517 B1
(45) Date of Patent: Sep. 24, 2002

(54) FASTENING CLAMP FOR JOINT PORTION OF OBLONG HOSES

(75) Inventor: Samon Tanaka, Suwa (JP)

(73) Assignee: Kanesan Manufacturing Co., Ltd., Nagano-Ken (JP)

( * ) Notice: Subject to any disclaimer, the term of this patent is extended or adjusted under 35 U.S.C. 154(b) by 0 days.

(21) Appl. No.: 09/862,598

(22) Filed: May 23, 2001

(30) Foreign Application Priority Data

Dec. 15, 2000 (JP) ..... 2000-381603

(51) Int. Cl.[7] ..... F16L 33/02
(52) U.S. Cl. ..... 24/20 R
(58) Field of Search ..... 24/20 R, 20 S, 24/27, 19, 20 EE, 20 TT

(56) References Cited

U.S. PATENT DOCUMENTS 2,503,223 A * 4/1950 Stade
2,685,719 A * 8/1954 Golden
2,793,414 A * 5/1957 Arras
3,008,206 A * 11/1961 Meese et al.
3,358,337 A * 12/1967 Schuchardt
4,099,298 A * 7/1978 Gimenez
4,430,775 A * 2/1984 Arthur
4,858,279 A * 8/1989 Kato et al.
4,969,240 A * 11/1990 Sauer
5,157,815 A * 10/1992 Dyer
6,053,504 A * 4/2000 Winterhoff et al.

* cited by examiner

*Primary Examiner*—James R. Brittain
(74) *Attorney, Agent, or Firm*—Rabin & Berdo, P.C.

(57) ABSTRACT

To perform fastening work quickly while performing positive fastening, in a fastening clamp for a joint portion of oblong hoses, a strip-like leaf spring material is rolled into an oblong shape, a cutaway is provided in a circumferential direction on one end side, the other end side is formed into a thin shape so as to insert into the cutaway, one end side and the other end side are caused to intersect with each other to be curved inwardly from an inner circumferential surface, respectively, and end portions thereof are bent outwardly in a radial direction to project from an outer circumference thereof.

1 Claim, 2 Drawing Sheets

FASTENING CLAMP FOR JOINT PORTION OF OBLONG HOSES

BACKGROUND OF THE INVENTION

The present invention relates to a fastening clamp for a joint portion of an oblong hose, and more particularly to a clamp for fastening and fixing the joint portion when oblong hoses having different diameters are coupled with each other while one hose is inserted into the other.

For example, in an under-floor warming system, in the case where a pipe for flowing warm water is arranged to be inserted into oblong hoses having an oblong shape in cross section for heat insulation, when the oblong hoses are to be connected to each other through a coupling member, the end portions of the oblong hoses are inserted into the joint member. Under this condition, the oblong hoses are fixed by fastening from the outside with a clamp.

Then, in the clamp that has been conventionally used, for example, a strip leaf spring material is wound like an oblong, the abutment end portions are bent outwardly in the radial direction, and the both end portions projected outwardly are fastened by means of a bolt and nut to decrease the diameter.

However, such a conventional clamp has a problem in fastening force, and also, since the nut has to be screwed and unscrewed for every case of fastening and releasing, it takes a long time.

SUMMARY OF THE INVENTION

In view of the foregoing defects, an object of the present invention is to provide a fastening clamp for a joint portion of oblong hoses that may fasten sufficiently and quickly.

According to the present invention, there is provided a fastening clamp for a joint portion of oblong hoses, in which a strip-like leaf spring material is rolled into an oblong shape, a cutaway is provided in a circumferential direction on one end side, the other end side is formed into a thin shape so as to insert into the cutaway, one end side and the other end side are caused to intersect with each other to be curved inwardly from an inner circumferential surface, respectively, and end portions thereof are bent outwardly in a radial direction to project from an outer circumference thereof.

DESCRIPTION OF THE PREFERRED EMBODIMENTS

Figure 1:
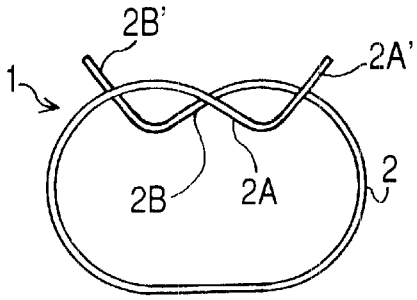
FIG. 1 is a front view of a clamp according to the present invention in a free condition.
Figure 2:
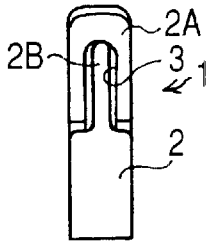
FIG. 2 is a right side elevation view of the clamp according to the present invention in the free condition.
Figure 3:
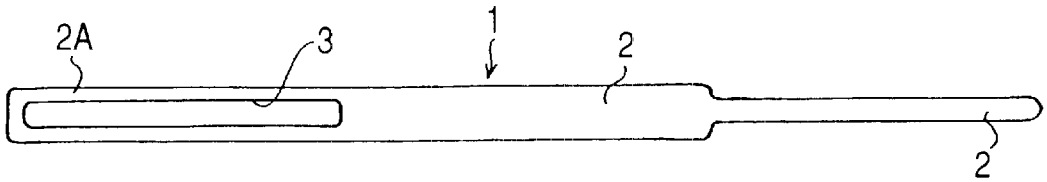
FIG. 3 is a developed plan view of the clamp according to the present invention.

An embodiment of the present invention will now be described with reference to the accompanying drawings.

A fastening clamp is designated by reference numeral 1 in the drawings. A strip-like leaf spring material 2 is rolled into an oblong shape to form the fastening clamp 1. A cutaway 3 is formed along the circumference on one end side 2A, and the other end side 2B is formed into a thin shape so as to be inserted into the cutaway 3.

Then, one end side 2A and the other end side 2B are caused to intersect with each other, to be curved inwardly from the inner circumferential surface and furthermore, the end portions 2A' and 2B' are bent outwardly in the radial direction to project from the outer circumferential surface.

The operation of the embodiment will now be described.

Figure 6:
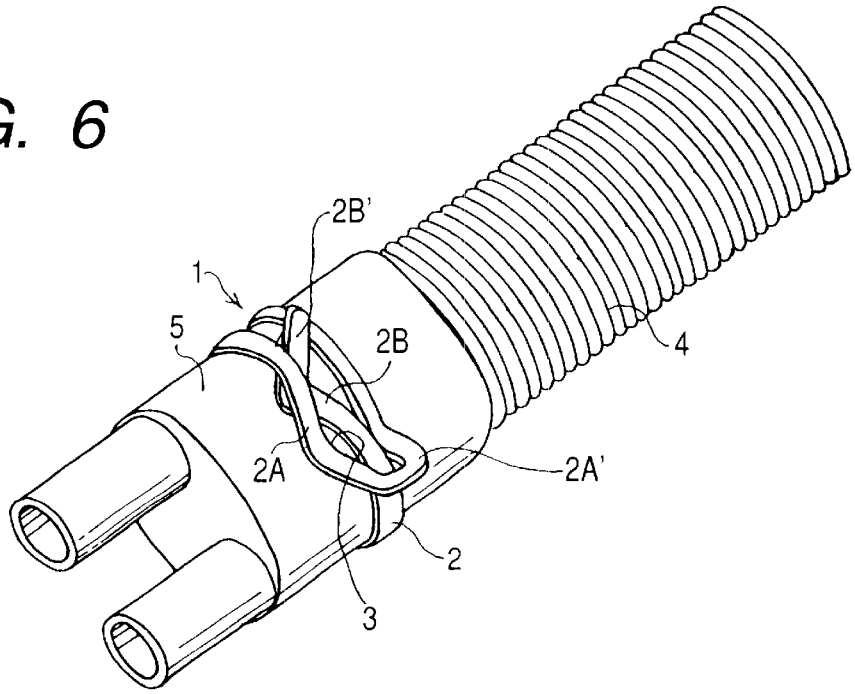
FIG. 6 is an illustration of the clamp in use condition according to the present invention.

FIG. 6 shows a use example of the present invention. An end of a bellows-type oblong hose 4 containing a pipe (not shown) for flowing hot water inside is inserted into a joint member 5. Under this condition, the clamp fastens the outer circumference of the joint member 5.

Figure 4:
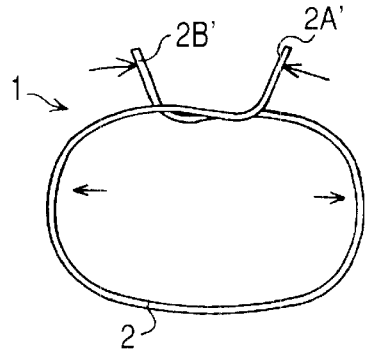
FIG. 4 is a front view of the clamp according to the present invention under the condition that the diameter is increased.
Figure 5:
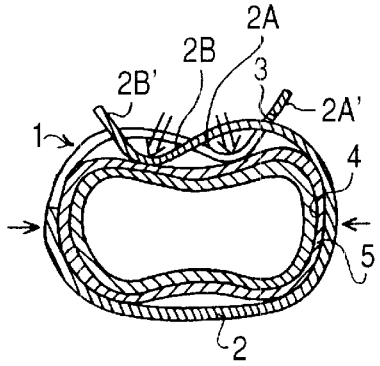
FIG. 5 is a cross-sectional view of the clamp under the fastened condition according to the present invention.

In this case, first of all, the end portions 2A' and 2B' of the fastening clamp 1 are pressurized so as to be narrowed as shown in FIG. 4 by using a tool such as pliers (not shown). Thus, the diameter is increased. Then, when the pressure by the pliers or the like is released in a predetermined position of the outer circumference of the joint member 5, the diameter is decreased by a natural spring force so that the joint member 5 is fastened firmly from the outer circumference thereof. Also, at this time, as shown in FIG. 5, since the bent portions of one end side 2A and the other end side 2B press firmly inwardly as indicated by arrows, a further fastening effect is ensured.

With such a structure and an operation of the present invention, it is possible to perform the positive fastening in comparison with the conventional case. Also, since the spring force is utilized and the diameter can be easily increased or decreased by using a tool such as pliers, a troublesome work such as screwing the nut as in the conventional case is not required. The fastening work may be performed quickly.

What is claimed is:

1. A fastening clamp for a joint portion of oblong hoses, comprising:

a strip-like leaf spring material having essentially an oblong shape, and having a cutaway provided on one end side thereof, the cutaway extending in a circumferential direction, an other end side of said leaf spring material being formed to have a thin shape so as to be inserted into said cutaway, the one end side and the other end side intersecting with each other, and each end side having a respective inwardly projecting crest that is curved inwardly to deviate from the oblong shape so that when said clamp is clamping on a joint member of an oblong hose, the respective inwardly projecting crests press into the joint member to increase a clamping effect of said clamp, end portions of said respective end sides being bent outwardly in a radial direction to project from an outer circumference of the oblong shape.

* * * * *